United States Patent [19]

Soucy

[11] Patent Number: 4,753,138

[45] Date of Patent: Jun. 28, 1988

[54] MAGNETIC HAMMER HANDLE CAP

[76] Inventor: Eugene H. Soucy, 71 Price Blvd., West Hartford, Conn. 06119

[21] Appl. No.: 35,860

[22] Filed: Apr. 8, 1987

[51] Int. Cl.[4] ..... B25D 1/04

[52] U.S. Cl. ..... 81/24; 81/492

[58] Field of Search ..... 81/24, 23, 492, 489; 7/901; 294/65.5

[56] References Cited

U.S. PATENT DOCUMENTS

| | | | |
|---|---|---|---|
| 1,441,903 | 1/1923 | Balaziuk . | |
| 2,491,860 | 12/1949 | Ingraham . | |
| 2,597,400 | 5/1952 | Stogsdill et al. . | |
| 2,788,815 | 4/1957 | D'Aoust | 7/901 |
| 3,228,720 | 1/1966 | Jordan | 81/24 |
| 3,425,468 | 2/1969 | Soucy | 81/489 |
| 3,543,821 | 12/1970 | Johnson | 81/24 |

*Primary Examiner*—Frederick R. Schmidt

*Assistant Examiner*—Bradley I. Vaught

*Attorney, Agent, or Firm*—Fleit, Jacobson, Cohn & Price

[57] ABSTRACT

A handle cap designed for use on a tool handle is disclosed. The handle cap has a cavity which forms an annular rim portion and an inner face. The annular rim portion of the cap is sleeved over an end of the tool handle so that the tool handle protrudes into the cavity and is abutted by the inner face of the cavity. The handle cap includes a tapered, projecting end portion extending outwardly in the direction of the longitudinal axis of the tool handle. The end portion has a channel formed therein which extends through the end portion and within which is fixed an elongated, permanent magnet. By using a handle cap which includes a projecting end portion as described, it is possible to use a longer and more powerful magnet than was possible in previous devices.

2 Claims, 1 Drawing Sheet

MAGNETIC HAMMER HANDLE CAP

BACKGROUND OF THE INVENTION

This invention relates to an attachment for the handle of a hammer or similar tool and more particularly to a rubber, plastic or equivalent cap which includes a magnet therein and which is sleeved over an end of the handle. One such known attachment is disclosed in my U.S. Pat. No. 3,425,468. This patent illustrates a handle mounted cap including a disc like permanent magnet embedded in a rim portion of the cap. The permanent magnet is used to contact a nail and initially tack and set the nail in a wall. The nail is subsequently driven home by the head of the hammer which is located on the other end of the handle.

SUMMARY OF THE INVENTION

It is an object of this invention to increase the size and therefore the strength of the magnet which is used in a handle mounted magnetic cap.

It is a feature of this invention to fix a permanent magnet in a projecting end portion of the magnetic cap, and to extend the projecting end portion outwardly away from the handle in the longitudinal direction of the handle.

It is a further feature of this invention to taper such a projecting end portion.

It is an advantage of this invention that a longer, heavier and more powerful magnet may be utilized in the handle cap so that a user may pick up a nail or even several nails more easily than by using prior devices which utilize smaller, less powerful magnets.

It is a further advantage of this invention that by using a projecting end portion which is tapered, it is possible for the user to tack nails into a wall close to corners, where space is limited.

DETAILED DESCRIPTION OF THE PREFERRED EMBODIMENT

Figure 1:
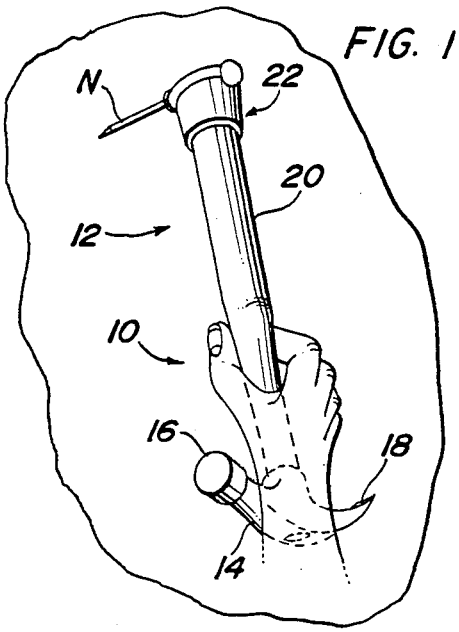
FIG. 1 is a perspective view of a hammer equipped with a handle cap according to the instant invention and which is being used to tack a nail into a wall.

Referring now to FIGS. 1–4, a tool, such as a hammer, designated in FIG. 1 generally by the number 10, includes a handle 12, which may, for example, be made of wood. Hammer 10 includes the usual head 14 which has an enlarged, nail driving head portion 16 and a flattened, nail extracting portion 18. Head 14, preferably formed of metal, is mounted at one axial end of handle 12. Handle 12 includes hand gripping portion 20.

Figure 3:
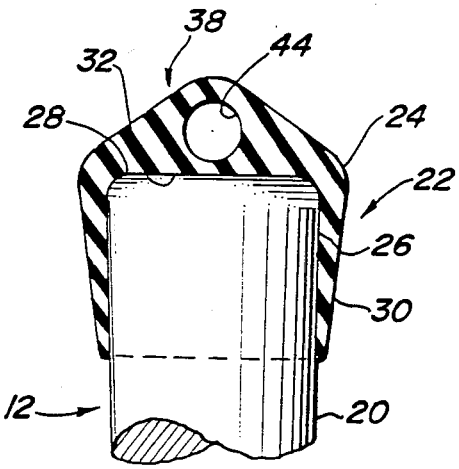
FIG. 3 is a sectional view of the handle cap shown in FIG. 2 which is taken along the plane of section line 3—3.

Unique attachment 22 is disposed at an axial end of handle 12 opposite the end thereof at which head 14 is mounted. Referring to FIG. 3, it can be seen that the unique attachment 22 is formed as a handle cap 24. Cap 24 can be made of rubber, for example a molded rubber, a suitable plastic material, or even metal if desired. Handle 12 includes a cap receiving portion 26 and an end surface 28. Cap 24 is formed with a cavity therein which forms an annular rim portion 30. Annular rim portion 30 of the cap is sleeved over and forced onto cap receiving portion 26 of the handle until end surface 28 abuts with inner face 32 of the cavity. Cap 24 may be snugly retained by friction on cap receiving portion 26 of the handle as shown, or may be secured to the handle by screws or other fasteners.

Cap 24 has a tapered, projecting end portion 38 extending in the direction of the longitudinal axis of handle 12 outwardly and away from annular rim portion 30. Tapered, projecting end portion 38, illustrated by way of example in FIG. 4, includes a tapered, intermediate portion 40 and a partial cylindrical portion 42. A channel 44 is formed through end portion 38 transversely of the longitudinal axis of handle 12. This channel preferably extends in a direction which is substantially perpendicular to the longitudinal axis of handle 12.

Figure 2:
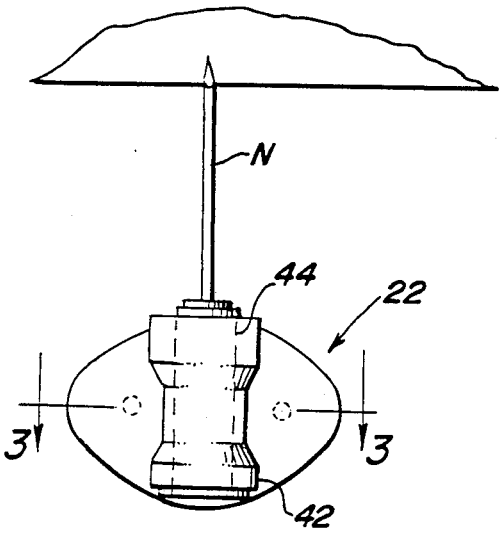
FIG. 2 is a top plan view of the handle cap illustrated in FIG. 1.
Figure 4:
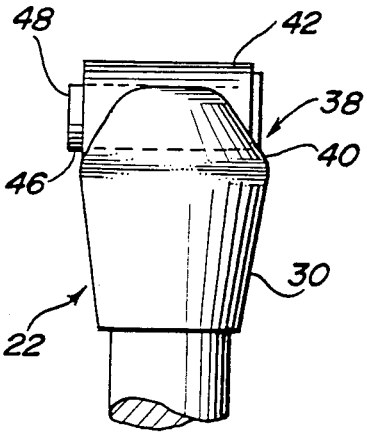
FIG. 4 is a side elevational view of the handle cap as shown in FIG. 2.

An elongated, cylindrical, permanent magnet 46 is adhesively secured, press fit, or otherwise fixed within the channel 44 and fills the channel. A planar end surface 48 of the magnet is exposed. The end surface 48 may either extend slightly beyond the end of partial cylindrical portion 42, may be flush therewith, or may even be slightly recessed within channel 44. As seen in FIGS. 2 and 4, cylindrical, permanent magnet 46 is disposed with its longitudinal axis extending transversely and preferably substantially perpendicular to the longitudinal axis of handle 12. The cylindrical magnet 46 fills channel 44 and extends axially a distance approximately the same as the width or diameter of hand gripping portion 20 of handle 12. If desired, channel 44 may be formed such that it passes only partially through portion 42.

It should be apparent from the foregoing that the hammer 10 with the attachment 22 disposed thereon is useful in numerous applications such as, for example, in the application of dry wall. As can be seen in FIGS. 1 and 2, the magnet equipped hammer is used to pick up a nail N by contacting planar end surface 48 with the head of the nail. It is then possible to tack the nail into a wall in a single pick up and starting motion. Head 14 of the hammer may conveniently be used to provide a hand grip for use whenever a nail N is tacked into the wall. After the nail has been tacked into the wall, the user turns the handle around and drives the nail home in the customary manner. It should be clear that the user is able to do this with one arm, leaving the other arm free to hold and position a dry wall panel.

By utilization of a handle cap which includes a projecting end portion as described, it is possible to use a longer, more massive, more powerful and better quality magnet than was possible in previous devices. Cylindrical permanent magnet 46 may extend in the longitudinal direction a distance which is the same as or even greater than the overall width of handle 12. The use of a larger, heavier and more powerful magnet in the handle cap allows a user to pick up a nail or even several nails more easily than prior devices which utilize smaller, less powerful magnets.

In addition, by utilization of a handle cap which includes a projecting end portion which is tapered as described, it is possible to tack nails into a wall close to corners, where space is limited, without interference by the entire width or diameter of the handle 12.

While the present invention has been disclosed in connection with the preferred embodiment thereof, it should be understood that there may be other embodiments which fall within the spirit and scope of the invention as defined by the following claims.

What is claimed:

1. A handle cap for use on a cap receiving portion of a tool handle and having a cavity therein which forms an annular rim portion and an inner face, said tool handle having a longitudinal axis, said annular rim portion sleeved over, forced onto and snugly retained on said cap receiving portion so that said tool handle protrudes into said cavity and said inner face abuts an end surface of said tool handle, said handle cap including a tapered, projecting end portion extending outwardly along said longitudinal axis away from said cavity and from said end surface of said tool handle, said tapered, projecting end portion comprising a tapered, intermediate portion and a partial cylindrical portion, said tapered, intermediate portion smoothly merging into said partial cylindrical portion, said tapered, projecting end portion having a channel formed therein transversely of the longitudinal axis of said tool handle and extending through said projecting end portion, an elongated, permanent magnet fixed within and completely filling said channel, said elongated, permanent magnet having an exposed, planar end surface.

2. A hammer including a handle, a head mounted at one axial end of said handle and a handle cap received on a cap receiving portion of said handle disposed at an opposite axial end of said handle, said handle cap having a cavity therein which forms an annular rim portion and an inner face, said handle having a longitudinal axis, said annular rim portion sleeved over, forced onto and snugly retained on said cap receiving portion so that said handle protrudes into said cavity and said inner face abuts an end surface of said handle, said handle cap including a tapered, projecting end portion extending outwardly along said longitudinal axis away from said cavity and from said end surface of said handle, said tapered, projecting end portion comprising a tapered, intermediate portion and a partial cylindrical portion, said tapered, intermediate portion smoothly merging into said partial cylindrical portion, said tapered, projecting end portion having a channel formed therein transversely to the longitudinal axis of said handle and extending through said projecting end portion, an elongated, permanent magnet fixed within and completely filling said channel, said elongated, permanent magnet having an exposed, planar end surface for contacting a loose nail so that said nail may be tacked onto a wall and subsequently driven home with said head.

* * * * *